US011834824B2

(12) United States Patent
Zemler et al.

(10) Patent No.: US 11,834,824 B2
(45) **Date of Patent: *Dec. 5, 2023**

(54) PROCESS FOR ASSEMBLING A FIREPROOF SYSTEM WITHIN A STICK BUILD EXTERIOR DYNAMIC CURTAIN WALL FAçADE

(71) Applicant: Hilti Aktiengesellschaft, Schaan (LI)

(72) Inventors: Matthew Zemler, Corinth, TX (US); Arndt Andresen, North Richland Hills, TX (US); Nathan Jennings, Little Elm, TX (US); Chad Stroike, Roanoke, TX (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 17/938,738

(22) Filed: Oct. 7, 2022

(65) Prior Publication Data

US 2023/0038158 A1 Feb. 9, 2023

Related U.S. Application Data

(60) Division of application No. 16/610,397, filed as application No. PCT/EP2018/063079 on May 18, (Continued)

(51) Int. Cl.
*E04B 1/76* (2006.01)
*E04B 1/94* (2006.01)
(Continued)

(52) U.S. Cl.
CPC ..... *E04B 1/7675* (2013.01); *E04B 1/7616* (2013.01); *E04B 1/7625* (2013.01); (Continued)

(58) Field of Classification Search
CPC ..... E04B 1/948; E04B 2/96; E04B 1/7675; E04B 1/7616; E04B 1/7625; E04B 2/90; (Continued)

(56) References Cited

U.S. PATENT DOCUMENTS 6,360,502 B1 3/2002 Stahl, Jr.
D502,147 S 2/2005 Stahl, Sr.
(Continued)

FOREIGN PATENT DOCUMENTS

CA 2787642 3/2013
CA 2841523 9/2014
(Continued)

OTHER PUBLICATIONS

International Search Report dated Aug. 23, 2018, in PCT/EP2018/063079.
(Continued)

*Primary Examiner* — Rodney Mintz
(74) *Attorney, Agent, or Firm* — Grüneberg and Myers PLLC

(57) ABSTRACT

An approved dynamic construction is used for effectively thermally insulating and sealing of a sating slat between a floor of a building and an exterior wall construction. The exterior wall construction includes a curtain wall configuration defined by an interior wall glass surface, including one or more aluminum framing members. In particular, a process is useful for assembling a fireproof system within a stick build exterior dynamic curtain wall façade, which includes glass, especially vision glass extending to the finished floor level below.

15 Claims, 2 Drawing Sheets

Related U.S. Application Data

2018, now Pat. No. 11,492,799, which is a continuation of application No. 15/600,295, filed on May 19, 2017, now Pat. No. 10,202,759.

(51) Int. Cl.

| | |
|---|---|
| ***E04B 2/90*** | (2006.01) |
| ***E04B 2/96*** | (2006.01) |
| ***E04B 1/68*** | (2006.01) |
| ***E04B 1/84*** | (2006.01) |

(52) U.S. Cl.

CPC ..... *E04B 1/948* (2013.01); *E04B 2/90* (2013.01); *E04B 2/96* (2013.01); *E04B 1/6815* (2013.01); *E04B 1/7612* (2013.01); *E04B 1/94* (2013.01); *E04B 2001/8438* (2013.01)

(58) Field of Classification Search

CPC ..... E04B 1/6815; E04B 1/7612; E04B 1/94; E04B 2001/8438; Y02A 30/00

See application file for complete search history.

(56) References Cited

U.S. PATENT DOCUMENTS

| | | | |
|---|---|---|---|
| 7,240,905 | B1 | 7/2007 | Stahl, Sr. |
| 7,373,761 | B2 | 5/2008 | Stahl, Sr. |
| 7,424,793 | B1 | 9/2008 | Shriver |
| 7,427,050 | B2 | 9/2008 | Stahl, Sr. et al. |
| 7,523,590 | B2 | 4/2009 | Stahl, Sr. |
| 7,596,914 | B2 | 10/2009 | Stahl, Sr. et al. |
| 7,685,792 | B2 | 3/2010 | Stahl, Sr. et al. |
| 7,694,474 | B1 | 4/2010 | Stahl, Sr. et al. |
| 7,765,753 | B1 | 8/2010 | Shriver |
| 7,797,893 | B2 | 9/2010 | Stahl, Sr. et al. |
| 7,827,746 | B2 | 11/2010 | Speck |
| 7,856,775 | B2 | 12/2010 | Stahl, Jr. |
| 7,886,491 | B1 | 2/2011 | Shriver |
| D657,232 | S | 4/2012 | Stahl, Sr. et al. |
| 8,375,666 | B2 | 2/2013 | Stahl, Jr. et al. |
| 8,397,452 | B2 | 3/2013 | Stahl, Sr. et al. |
| 8,584,415 | B2 | 11/2013 | Stahl, Jr. et al. |
| 8,671,645 | B1 | 3/2014 | Shriver |
| 8,683,763 | B2 | 4/2014 | Shriver |
| 8,782,977 | B2 | 7/2014 | Burgess |
| 8,793,946 | B2 | 8/2014 | Stahl, Jr. et al. |
| 8,869,475 | B2 | 10/2014 | Lopes |
| 8,887,458 | B2 | 11/2014 | Lopes |
| 8,955,275 | B2 | 2/2015 | Stahl, Jr. |
| 9,016,013 | B2 | 4/2015 | Stahl, Jr. et al. |
| 9,869,086 | B2 | 1/2018 | Andresen |
| 10,017,939 | B2 | 7/2018 | Andresen |
| 10,138,629 | B2 | 11/2018 | Schulz-Hanke et al. |
| 10,202,759 | B2 | 2/2019 | Andresen et al. |
| 10,415,239 | B2 | 9/2019 | Schulz-Hanke et al. |
| 10,519,653 | B2 | 12/2019 | Schulz-Hanke et al. |
| 10,538,915 | B1 | 1/2020 | Zemler et al. |
| 10,648,172 | B2 | 5/2020 | Andresen et al. |
| 10,669,709 | B2 | 6/2020 | Zemler et al. |
| 10,731,338 | B1 | 8/2020 | Zemler et al. |
| 10,837,169 | B2 | 11/2020 | Ober et al. |
| 11,002,007 | B2 | 5/2021 | Zemler et al. |
| 11,035,121 | B2 | 6/2021 | Klein et al. |
| 11,060,280 | B2 | 7/2021 | Zemler et al. |
| 11,091,908 | B2 | 8/2021 | Paetow et al. |
| 11,124,962 | B2 | 9/2021 | Andresen et al. |
| 11,339,566 | B2 | 5/2022 | Zemler et al. |
| 11,492,799 | B2 * | 11/2022 | Zemler ..... E04B 1/7675 |
| 2006/0138251 | A1 | 6/2006 | Stahl |
| 2007/0125018 | A1 | 6/2007 | Stahl |
| 2007/0151183 | A1 | 7/2007 | Stahl et al. |
| 2007/0175125 | A1 | 8/2007 | Stahl et al. |
| 2007/0204540 | A1 | 9/2007 | Stahl, Sr. et al. |
| 2007/0261339 | A1 | 11/2007 | Stahl et al. |
| 2007/0261343 | A1 | 11/2007 | Stahl et al. |
| 2009/0126297 | A1 | 5/2009 | Stahl, Jr. |
| 2010/0107532 | A1 | 5/2010 | Shriver |
| 2011/0011019 | A1 | 1/2011 | Stahl, Jr. et al. |
| 2011/0088342 | A1 | 4/2011 | Stahl, Sr. et al. |
| 2011/0094759 | A1 | 4/2011 | Lopes |
| 2013/0061544 | A1 | 3/2013 | Stahl, Jr. et al. |
| 2013/0091790 | A1 | 4/2013 | Stahl, Jr. et al. |
| 2013/0097948 | A1 | 4/2013 | Burgess |
| 2014/0020915 | A1 | 1/2014 | Lopes |
| 2014/0137494 | A1 | 5/2014 | Stahl, Jr. et al. |
| 2014/0360115 | A1 | 12/2014 | Stahl, Jr. |
| 2015/0007515 | A1 | 1/2015 | Stahl, Jr. |
| 2015/0047276 | A1 | 2/2015 | Gandolfo et al. |
| 2016/0356034 | A1 | 12/2016 | Andresen |
| 2017/0145685 | A1 | 5/2017 | Andresen |
| 2017/0284085 | A1 | 10/2017 | Ting |
| 2017/0370097 | A1 | 12/2017 | Schulz-Hanke et al. |
| 2018/0002922 | A1 | 1/2018 | Schulz-Hanke et al. |
| 2018/0030724 | A1 | 2/2018 | Schulz-Hanke et al. |
| 2018/0258634 | A1 | 9/2018 | Schulz-Hanke et al. |
| 2018/0334799 | A1 | 11/2018 | Andresen et al. |
| 2019/0063064 | A1 | 2/2019 | Pactow et al. |
| 2019/0071865 | A1 | 3/2019 | Andresen et al. |
| 2019/0078327 | A1 | 3/2019 | Schulz-Hanke et al. |
| 2019/0284798 | A1 | 9/2019 | Klein et al. |
| 2020/0056371 | A1 | 2/2020 | Zemler et al. |
| 2020/0056372 | A1 | 2/2020 | Andresen et al. |
| 2020/0263417 | A1 | 8/2020 | Zemler et al. |
| 2020/0291644 | A1 | 9/2020 | Ober et al. |
| 2020/0325678 | A1 | 10/2020 | Zemler et al. |
| 2020/0332525 | A1 | 10/2020 | Klein et al. |
| 2021/0156141 | A1 | 5/2021 | Zemler et al. |
| 2021/0222423 | A1 | 7/2021 | Zemler et al. |
| 2021/0230869 | A1 | 7/2021 | Klein et al. |
| 2021/0381230 | A1 | 12/2021 | Andresen et al. |
| 2022/0127849 | A1 | 4/2022 | Zemler et al. |
| 2022/0154455 | A1 | 5/2022 | Zemler et al. |
| 2022/0268016 | A1 * | 8/2022 | Zemler ..... E04B 1/7616 |

FOREIGN PATENT DOCUMENTS

| | | |
|---|---|---|
| CA | 2849597 | 12/2014 |
| GB | 2503465 | 1/2014 |
| JP | 2011-190613 | 9/2011 |
| JP | 2011-190614 | 9/2011 |
| KR | 10-1168757 | 7/2012 |
| WO | 2007/061572 | 5/2007 |
| WO | 2014/081446 | 5/2014 |
| WO | 2015/023313 | 2/2015 |

OTHER PUBLICATIONS

Written Opinion dated Aug. 23, 2018, in PCT/EP2018/063079.

Document 6, Filed Oct. 27, 2022, "First Amended Complaint for Patent Infringement" in Case 1:22-cv-01383-CFC (in the U.S. District Court for the District of Delaware).

Exhibit 1 to Document 6, Filed Oct. 27, 2022, "First Amended Complaint for Patent Infringement" in Case 1:22-cv-01383-CFC (in the U.S. District Court for the District of Delaware).

Exhibit 2 to Document 6, Filed Oct. 27, 2022, "First Amended Complaint for Patent Infringement" in Case 1:22-cv-01383-CFC (in the U.S. District Court for the District of Delaware).

Exhibit 3 to Document 6, Filed Oct. 27, 2022, "First Amended Complaint for Patent Infringement" in Case 1:22-cv-01383-CFC (in the U.S. District Court for the District of Delaware).

Exhibit 4 to Document 6, Filed Oct. 27, 2022, "First Amended Complaint for Patent Infringement" in Case 1:22-cv-01383-CFC (in the U.S. District Court for the District of Delaware).

Exhibit 5 to Document 6, Filed Oct. 27, 2022, "First Amended Complaint for Patent Infringement" in Case 1:22-cv-01383-CFC (in the U.S. District Court for the District of Delaware).

Exhibit 6 to Document 6, Filed Oct. 27, 2022, "First Amended Complaint for Patent Infringement" in Case 1:22-cv-01383-CFC (in the U.S. District Court for the District of Delaware).

Exhibit 7 to Document 6, Filed Oct. 27, 2022, "First Amended Complaint for Patent Infringement" in Case 1:22-cv-01383-CFC (in the U.S. District Court for the District of Delaware).

(56) References Cited

OTHER PUBLICATIONS

Exhibit 8 to Document 6, Filed Oct. 27, 2022, "First Amended Complaint for Patent Infringement" in Case 1:22-cv-01383-CFC (in the U.S. District Court for the District of Delaware).
Exhibit 9 to Document 6, Filed Oct. 27, 2022, "First Amended Complaint for Patent Infringement" in Case 1:22-cv-01383-CFC (in the U.S. District Court for the District of Delaware).
Exhibit 10 to Document 6, Filed Oct. 27, 2022, "First Amended Complaint for Patent Infringement" in Case 1:22-cv-01383-CFC (in the U.S. District Court for the District of Delaware).
Exhibit 11 to Document 6, Filed Oct. 27, 2022, "First Amended Complaint for Patent Infringement" in Case 1:22-cv-01383-CFC (in the U.S. District Court for the District of Delaware).
Exhibit 12 to Document 6, Filed Oct. 27, 2022, "First Amended Complaint for Patent Infringement" in Case 1:22-cv-01383-CFC (in the U.S. District Court for the District of Delaware).
Exhibit 13 to Document 6, Filed Oct. 27, 2022, "First Amended Complaint for Patent Infringement" in Case 1:22-cv-01383-CFC (in the U.S. District Court for the District of Delaware).
Exhibit 14 to Document 6, Filed Oct. 27, 2022, "First Amended Complaint for Patent Infringement" in Case 1:22-cv-01383-CFC (in the U.S. District Court for the District of Delaware).
Exhibit 15 to Document 6, Filed Oct. 27, 2022, "First Amended Complaint for Patent Infringement" in Case 1:22-cv-01383-CFC (in the U.S. District Court for the District of Delaware).
Exhibit 16 to Document 6, Filed Oct. 27, 2022, "First Amended Complaint for Patent Infringement" in Case 1:22-cv-01383-CFC (in the U.S. District Court for the District of Delaware).
Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 1 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 2 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 3 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 4 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 5 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 6 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 7 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 8 to Document 16, Filed Dec. 19, 2022, "Specified Technologies, Inc.'s Answer To First Amended Complaint for Patent Infringement, Defenses, and Counterclaims" in Case 1:22- cv-01383-CFC (in the U.S. District Court for the District of Delaware).
Exhibit 9 to Document 16, Filed Dec. 19, 2022, "Specified Technologies, Inc.'s Answer To First Amended Complaint for Patent Infringement, Defenses, and Counterclaims" in Case 1:22- cv-01383-CFC (in the U.S. District Court for the District of Delaware).
Exhibit 10 to Document 16, Filed Dec. 19, 2022, "Specified Technologies, Inc.'s Answer To First Amended Complaint for Patent Infringement, Defenses, and Counterclaims" in Case 1:22-cv-01383-CFC (in the U.S. District Court for the District of Delaware).
Exhibit 11 to Document 16, Filed Dec. 19, 2022, "Specified Technologies, Inc.'s Answer To First Amended Complaint for Patent Infringement, Defenses, and Counterclaims" in Case 1:22-cv-01383-CFC (in the U.S. District Court for the District of Delaware).
Exhibit 12 to Document 16, Filed Dec. 19, 2022, "Specified Technologies, Inc.'s Answer To First Amended Complaint for Patent Infringement, Defenses, and Counterclaims" in Case 1:22-cv-01383-CFC (in the U.S. District Court for the District of Delaware).

* cited by examiner

PROCESS FOR ASSEMBLING A FIREPROOF SYSTEM WITHIN A STICK BUILD EXTERIOR DYNAMIC CURTAIN WALL FAçADE

CROSS-REFERENCE TO RELATED APPLICATIONS

This application is a divisional application of U.S. application Ser. No. 16/610,397, filed on Nov. 1, 2019, which was the National Stage entry under § 371 of International Application No. PCT/EP2018/063079, filed on May 18, 2018, and which claims the benefit of priority to U.S. application Ser. No. 15/600,295, filed on May 19, 2017, The content of each of these applications is hereby incorporated by reference in its entirety.

BACKGROUND OF THE INVENTION

Field of the Invention

The present invention relates to the field of constructions, assemblies and systems designed to thermally and acoustically insulate and seal a safing slot area defined between a curtain wall and the individual floors of a building. In particular, the present invention relates to a process for assembling a fireproof system within a stick build exterior dynamic curtain wall façade, which includes glass, especially vision glass extending to the finished floor level below.

Description of Related Art

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

Due to the recent developments on the building construction market, unlike when unitized panels are used, the outer façade of a building (curtain wall façade) will be assembled piece by piece directly on the jobsite requiring at the same time sufficient fire stopping in the created safing slot, A process for installing sufficient fire stopping is highly desirable that is quick and clean when a stick build curtain wall façade is assembled piece by piece directly on the jobsite. Further, this process should ensure the quality of fire protection that is required according to various standards.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This safing slot is essential to slow the passage of fire and combustion gases between floors, Therefore, it is of great importance to improve fire stopping at the safing slot in order to keep heat, smoke and flames from spreading from one floor to an adjacent floor. It is important to note that the firestop at the perimeter slab edge is considered a continuation of the fire-resistance-rating of the floor slab. In general, the standard fire test method NFPA 285 provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls have to pass the NFPA 285 test.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F-rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance-rating of the floor assembly.

Although some glass and frame technologies have been developed that are capable of passing applicable fire test and building code requirements, there is hardly any system that addresses the exception stated in the International Building Code IBC 2012 Section 715.4 and fulfills the code section ASTM E 2307 full-scale testing.

However, there is no system known that can be easily installed that addresses above mentioned exception and at the same time complies with the requirements according to ASTM Designation: E 1399-97 (Reapproved 2005), in particular having a movement classification of class IV, Class IV is a combination of thermal, wind, sway and seismic movement types. These have been tested according to the invention in both horizontal and vertical conditions. The E 1399, Standard Test Method for Cyclic Movement and Measuring the Minimum and Maximum Joint Widths of Architectural Joint Systems, is used for simulation of movements of the ground, such as for example an earthquake, or even movements under high wind load or life load. In particular, there is no system known that is used in a curtain wall structure that provides a dynamic system complying with ASTM E 1399, such as for example a curtain wall structure defined by an interior wall surface, which includes an interior panel, such as a back pan, extending over the interior surface thereof and at least one floor spatially disposed from the inner wall surface, thereby sealing of the sating slot between the floor and the back pan of this curtain wall, which extends between the interior wall surface of the interior panel and the outer edge of the floor, in particular when vision glass is employed. Said safing slot is needed to compensate dimensional tolerances of the concreted floor and to allow movement between the floor and the façade element caused by load, such by life, seismic or wind load.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions and which can be easily installed and minimizes the materials used on the jobsite. In particular, there is a need for a system that when installed during the building up the curtain wall façade, prevents the spread of fire when vision glass of a curtain wall structure extends to the finished floor level below even when exposed to certain movements (complying with the requirements for a class IV movement).

SUMMARY OF THE INVENTION

In view of the above, it is an object of the present invention to provide a process for assembling a fireproof system within a stick build exterior dynamic curtain wall façade, which includes glass, especially vision glass extending to the finished floor level below.

Further, it is an object of the present invention to provide a process for installing a system within a curtain wall façade that is Hill-scale ASTM E 2307 as well as ASTM E 1399 tested, to address the code exception, to avoid letters and engineering judgments, and to secure and provide defined/tested architectural detail for this application, in particular, by providing a tested system for fire- as well as movement-safe architectural compartmentation and which makes it easier for the installers to build up the curtain wall façade on the jobsite.

Still further, it is an object of the present invention to provide at the same time an installed fireproof system, which is used as an acoustic insulating and sealing system for effectively acoustically insulating and sealing of the safing slot between a curtain wall façade and the edge of a floor.

These and other objectives as they will become apparent from the ensuing description of the invention are solved by the present invention as described in various embodiments. Preferred embodiments further describe the invention.

In one aspect, the present invention provides a process for assembling a fireproof system within a stick build exterior dynamic curtain wall façade. In particular, it is an aspect of the present invention to provide such a process comprising the following steps:

- assembling a framing structure by attaching anchoring brackets to horizontal and vertical framing members and to the concrete and steel members of the façade to the building structure;
- installing the appropriate water gasket seals to the framing members to seal the framing structure and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to an upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the framing structure for glass installation;
- completion of the curtain wall façade by installing glass and appropriate sealing layers to the structure;
- installing a thermally resistant material into the substantially U-shaped cavity and the sating slot; and
- optionally applying an outer fire retardant coating positioned across the thermally resistant material installed in the sating slot and the adjacent portions of the vertical and horizontal framing members and the floor located thereadjacent.

In yet another aspect, the present invention provides an installed fireproof system, which is used as an acoustic insulating and sealing system within a stick build exterior dynamic curtain wall façade.

BRIEF DESCRIPTION OF THE FIGURES

The subject matter of the present invention is further described in more detail by reference to the following figures.

DETAILED DESCRIPTION OF THE INVENTION

Figure 1:
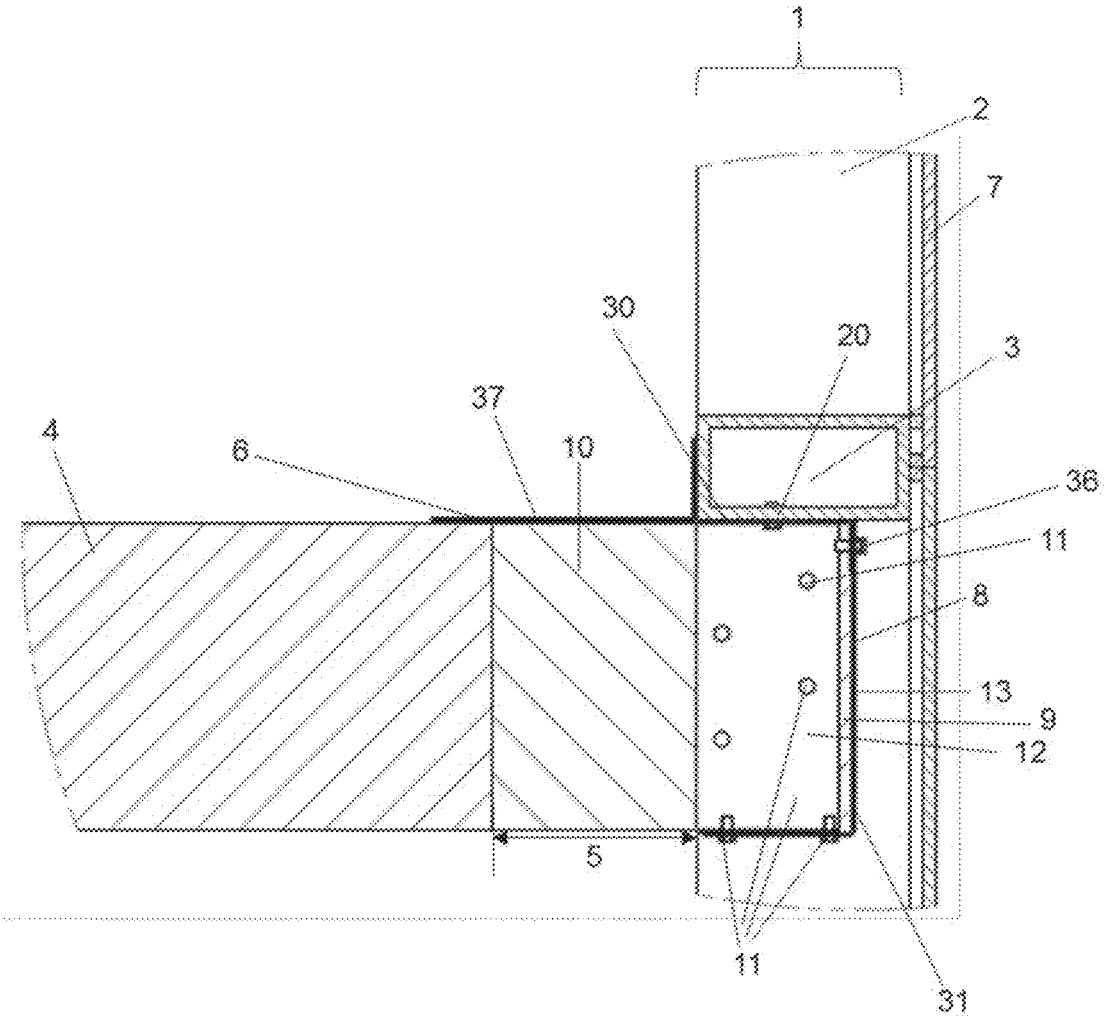
FIG. 1 shows a side cross-sectional view of the fireproof system in its final installation within a stick build exterior dynamic curtain wall façade.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" or "curtain wall façade or" "curtain wall assembly" in context with the present invention refers to a wall structure defined by an interior wall surface including one or more framing members and at least one floor spatially disposed from the interior wall surface of the curtain wall construction. In particular, this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the curtain wall construction as defined above, in particular, to the inner facing surface of the infilled vision glass and the inner facing surface of the framing members.

The term "cavity-shaped profile" in context with the present invention refers to any shaped profile that is capable of receiving a thermally resistant material for insulating. In particular, the cavity-shaped profile refers to a U-shaped profile, a trapezoidal-shaped profile, a triangular-shaped profile, rectangular-shaped profile, octagonal-shaped profile, preferably to a U-shaped cavity. These profiles can be formed from one or more components.

The process for assembling a fireproof system according to the present invention encompasses the use of different elements which provide in accordance with each other for a system that addresses the code exception and meets the requirements of standard method ASTM E 2307 and complies with the requirements of standard method ASTM E 1399, and is described in the following:

According to the present invention, the process for assembling a fireproof system within a stick build exterior dynamic curtain wall façade, comprises the following steps:

- assembling a framing structure by attaching anchoring brackets to horizontal and vertical framing members and to the concrete and steel members of the façade to the building structure;
- installing the appropriate water gasket seals to the framing members to seal the framing structure and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to an upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the framing structure for glass installation;
- completion of the curtain wall façade by installing glass and appropriate sealing layers to the structure;
- installing a thermally resistant material into the substantially U-shaped cavity and the sating slot; and
- optionally applying an outer fire retardant coating positioned across the thermally resistant material installed in the safing slot and the adjacent portions of the vertical and horizontal framing members and the floor located thereadjacent.

In particular, in a first step the framing structure for the curtain wall façade is assembled.

Anchoring brackets are attached to horizontal and vertical framing members and to the concrete and steel members of the façade to the building structure. Usually, rectangular aluminum tubing mullions and transoms are used according to the curtain wall system manufacturer's guidelines that will manufacture the elements for a stick built curtain wall façade.

In a second step, appropriate water gasket seals are installed to the framing members to seal the framing structure and building structure from water intrusion.

In a third step, the substantially U-shaped cavity is created by installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member. The connection of the two L-shaped members can be made via one or more screws, pins, bolts, anchors and the like. The back of the U-shaped cavity is positioned spatially disposed from the interior wall surface of the curtain wall construction, preferably spatially disposed from the inner surface of the vision glass infill.

This U-shaped cavity is considered for the purpose of facilitating fire stopping by receiving and encasing a thermally resistant material positioned in a safing slot present in those buildings utilizing a stick build curtain wall façade, in particular glass curtain wall façade, wherein the vision glass extends to the finished floor level, i.e., in the zero spandrel area of a glass curtain wall construction including only vision glass.

It is preferred that the L-shaped members are comprised of non-combustible material, preferably a metal material, most preferably steel, galvanized or plain. In a most preferred embodiment, the L-shaped members are made of a 12 or 18 gauge galvanized steel material or aluminum, such as an extruded aluminum. However, it is also possible that L-shaped members are comprised of a composite material or a material which is fiber-reinforced.

In one embodiment, the first leg of the first L-shaped member has a length of about 3 inch and a second leg of the first L-shaped member has a length of about 6 inch, and a first leg of the second L-shaped member has a length of about 1 inch and a second leg of the second L-shaped member has a length of about 3 inch. In an alternative embodiment, the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch.

However, it is also possible to form the cavity-shaped profile using one or more pieces which are bent or somehow fastened together to form the various profiles, such as a trapezoidal-shaped profile, a triangular-shaped profile, rectangular-shaped profile, or octagonal-shaped profile for receiving a thermally resistant material for insulating. The U-shaped cavity can be designed using various number of pieces. It can be constructed using a single piece but the cost will increase due to the complexity and number of required bends.

Preferably, the U-shaped cavity is formed from two L-shaped members, wherein the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch, making it easy for the manufacturer to assemble the stick build curtain wall façade.

Fastening of the two L-shaped members may be performed by fastening means selected from the group consisting of pins, expansion anchors, screws, screw anchors, bolts and adhesion anchors. Preferably fastening is performed by No. 10 self-drilling sheet metal screws. It is preferred that the fastening of the first L-shaped member takes place through the first leg and is fastened to the bottom of the horizontal framing member of the curtain wall construction. However, any other suitable fastening region may be chosen as long as maintenance of complete sealing of the sating slot is guaranteed.

In a next step, elements for supporting and attaching are installed to fasten the substantially U-shaped cavity to an inner facing side of the vertical framing member. Preferably, these elements have a substantially L-shaped profile and are positioned so that the gap between U-shaped cavity and the vertical framing member is closed due to the architectural structure of the glass curtain wall assembly, thereby forming a 5-sided box pan.

It is preferred that elements for supporting and attaching are comprised of a non-combustible material, preferably a metal material, most preferably steel. In a particular preferred embodiment of the present invention, these elements are angle brackets made from a 12 or 18 gauge galvanized steel material or aluminum, such as an extruded aluminum. In a most preferred embodiment, a first leg of the angle bracket has a length of about 3 inch and a second leg of the angle bracket has a length of about 1 inch. Dimensions and geometric design of these elements may be varied and adapted to address joint width and mullion location in a degree known to a person skilled in the art.

Dimensions, material and geometric design of the complete U-shaped cavity, also referred to as 5-sided box pan or zero spandrel box, may be varied and adapted to address joint width and transom location in a degree known to a person skilled in the art.

In a fifth step, additional gaskets, hardware, and components necessary to prepare the framing structure for glass installation are installed according to the curtain wall manufacture's guidelines; followed in a sixth step by completion of the curtain wall façade by installing glass and appropriate sealing layers to the structure.

The so assembled stick build curtain wall façade is complemented with a thermally resistant material installed into the substantially U-shaped cavity and the safing slot. In particular, the thermally resistant material installed into the substantially U-shaped cavity is a thermally resistant flexible material such as a mineral wool material, most preferably is a mineral wool bat insulation having a 3 inch thickness, 8-pcf density, installed with no compression. The thermally resistant material installed in the safing slot is a thermally resistant flexible mineral wool and installed with fibers running parallel to the outer edge of the floor and the curtain wall. Moreover, it is preferred that a min. 4 inch thick, 4-pcf density, mineral wool bat insulation is employed, if the U-shaped cavity is filled with an insulating material and most preferably installed with 25% compression in the nominal joint width. The mineral wool bat is to be installed flush with the top surface of the concrete floor. Splices, also referred to as butt joints in the lengths of the mineral batt insulation are to be tightly compressed together.

Alternatively, insulation of the safing slot is ensured by filling the cavity to a depth of 2⅞ inch with 4-pcf density mineral wool batt insulation with the fibers running parallel to the floor and compressing the packing material 25% vertically in the U-shaped cavity. This step is followed by installation of a thermally resistant material as above installed in the sating slot.

In order to finalize complete fire protection of the sating slot, in particular in front of the vertical framing members, a further thermally resistant material for insulating may be positioned in the sating slot in abutment with respect to the vertical framing member, i.e. located in front of the vertical framing member.

It is preferred that the thermally resistant material for insulating is a thermally resistant flexible material such as a mineral wool material, to facilitate placement thereof into the sating slot and in front of the vertical framing member.

This thermally resistant flexible material can be integrally connected to the thermally resistant flexible material installed in the safing slot, and preferably made of a thermally resistant flexible mineral wool material installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

In a particular preferred embodiment, the insulation material in the sating slot is installed continuously and in abutment with respect to the outer edge of the floor, the filled U-shaped cavity, and the interior facing surface of the vertical framing member.

It is preferred that the upper as well as the lower primary surfaces of the filled U-shaped cavity and the insulation material in the sating slot are flush with respect to the upper and lower side of the floor, and the sides of the U-shaped cavity, respectively.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

To improve fire stopping at the safing slot of an exterior dynamic curtain wall assembly, an outer fire retardant coating is applied and positioned across the thermally resistant material installed in the safing slot and the adjacent portions of the vertical and horizontal framing members and the floor located there adjacent. The sealing characteristics of the installed fireproof system within an exterior dynamic curtain wall façade shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicone sealants. For example, Hilti Firestop Joint Spray CFS-SP WB can be used as an outer fire retardant coating in accordance with the present invention. In one preferred embodiment of the present invention the outer fire retardant coating is an elastomeric outer fire retardant coating, water-based or silicone-based outer fire retardant coating, preferably a firestop joint spray. The outer fire retardant coating that can be applied in the installed system of the present invention is preferably in the form of an emulsion, spray, coating, foam, paint or mastic.

According to one embodiment of the present invention, it is preferred that the outer fire retardant coating has a wet film thickness of at least ⅛ inch or 2 mm. Additionally, it is preferable that the outer fire retardant coating covers the top of the thermally resistant flexible mineral wool material overlapping the outer edge of the floor and the interior face of the vertical and the horizontal framing member surface of the curtain wall assembly by a min. of ½ inch. The outer fire retardant material can be applied across the insulation installed in the safing slot and the adjacent areas of the interior wall surface and floor.

According to the present invention, the process for assembling a fireproof system within a stick build exterior dynamic curtain wall façade may further comprise the application of a silicone sealant, preferably a firestop silicone, in order to restrict air movement and to serve as a vapor barrier. The application of a silicone sealant allows the usage of an unfaced curtain wall insulating material, i.e., mineral wool without any foil or tape around the outside, in particular in cases, where the cavity-shaped profile consists of more the one pieces.

The installed fireproof system within a stick build exterior dynamic curtain wall façade of the present invention is also for acoustically insulating and sealing of a safing slot of a curtain wall structure. The material used for insulating may be of a sound resistant and/or air tight material, such as a mineral wool material coated with an acrylic- or silicone-based material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 a side cross-sectional view of the fireproof system in its final installation within a stick build exterior dynamic curtain wall façade is shown. In particular, FIG. 1 shows the installed fireproof system between the outer edge of a floor and the interior wall surface at a horizontal framing member (transom at floor level, i.e. zero spandrel) in a curtain wall construction, wherein the vision glass extends to the finished floor level below—glass curtain wall construction. The system is installed within the zero spandrel area of a glass curtain wall construction, defined by an interior wall surface 1 including one or more framing members, i.e., vertical framing member—mullion 2—and horizontal framing member—transom 3—which is located at the floor level, and at least one floor 4 spatially disposed from the interior wall surface 1 of the curtain wall construction defining the safing slot 5 extending between the interior wall surface 1 of the curtain wall construction and an outer edge 6 of the floor 4. The framing members 2 and 3 are infilled with vision glass 7 extending to the finished floor level below. The fireproof system comprises a first L-shaped member 30 and a second L-shaped member 31 connected to each other to form the U-shaped cavity 8, made of a non-combustible material, such as metal, preferably made from an 18 gauge galvanized steel material, for receiving a thermally resistant material for insulating 9 (shown as dashed lines). Supporting and attachment elements 11 fasten the substantially U-shaped cavity 8 to an inner facing side 12 of the vertical framing member 2. The supporting and attachment elements 11 are angle brackets made from 18 gauge galvanized steel material, preferably a first leg of the angle bracket has a length of about 3 inch and a second leg of the angle bracket has a length of about 1 inch. The elements for attachment 11 are No. 10 self-drilling sheet metal screws. Elements 20 for fastening the U-shaped cavity to the upper horizontal framing member 3 and upper locations of the vertical framing members 2 are preferably No. 10 self-drilling sheet metal screws. The back 13 of the U-shaped cavity is positioned spatially disposed from the interior wall surface of the curtain wall construction, preferably spatially disposed from the inner surface of the vision glass infill 7. It can be seen from FIG. 1 is that the first L-shaped member 30 has a first leg and a second leg perpendicular to each other, and the second L-shaped 31 member has a first leg and a second leg perpendicular to each other, wherein the first leg of the second L-shaped member 31 is connected to the second leg of the first L-shaped member 30, thereby forming a substantially U-shaped profile 8. The connection of the two L-shaped members 30, 31 occurs via a No. 10 self-drilling sheet metal screw 36. The L-shaped members 30, 31 are comprised of a non-combustible material, such as metal, preferably made from an 18 gauge galvanized steel material. In its final installation, the fireproof system comprises a thermally resistant material 9 for insulating that is positioned in U-shaped cavity 8. The thermally resistant material 9 preferably fills the cavity to a depth of 2⅞ inch with 4-pcf density mineral wool batt insulation with the fibers running parallel to the floor and is compressed 25% vertically in the U-shaped cavity 8. Another thermally resistant material 10 is installed in the safing slot and is preferably mineral wool, preferably having a min. 4-pcf density and a thickness of 4 inch, Not shown in FIG. 1 is that the thermally resistant flexible mineral wool material 10 is installed with fibers running parallel to the outer edge 6 of the floor 4. To improve fire stopping at the safing slot of an exterior dynamic curtain wall assembly, an outer fire retardant coating 37 is applied and positioned across the thermally resistant material 10 installed in the safing slot 5 and the adjacent portions of the vertical 2 and horizontal framing members 3 and the floor 4 located thereadjacent. In FIG. 1, the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch.

Figure 2:
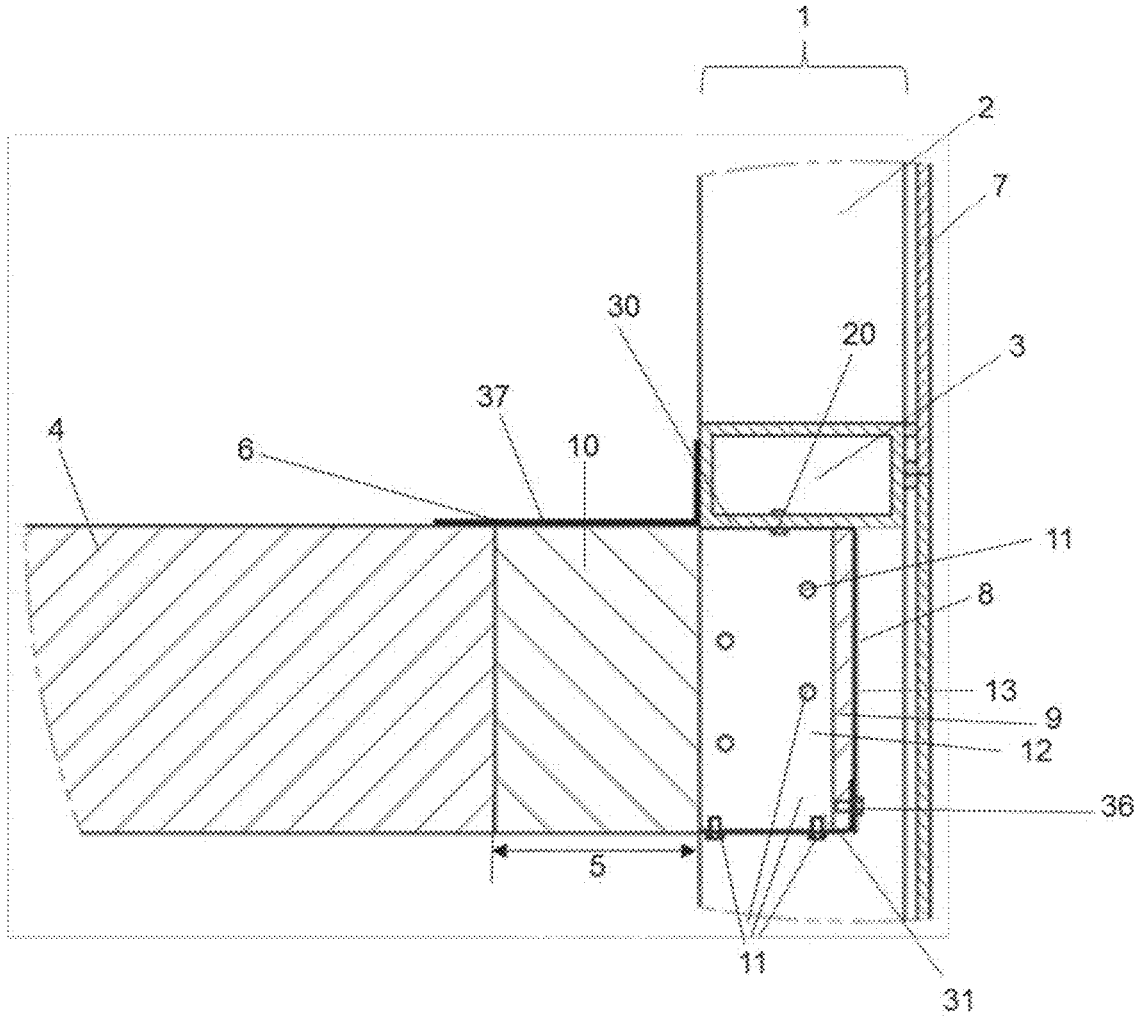
FIG. 2 shows a side cross-sectional view of another embodiment of the fireproof system in its final installation within a stick build exterior dynamic curtain wall façade.

FIG. 2 a side cross-sectional view of another embodiment of the fireproof system in its final installation within a stick build exterior dynamic curtain wall façade is depicted. In this embodiment the first leg of the first L-shaped member has a length of about 3 inch and a second leg of the first L-shaped member has a length of about 6 inch, and a first leg of the second L-shaped member has a length of about 1 inch and a second leg of the second L-shaped member has a length of about 3 inch. The remaining components are the same as described for FIG. 1.

It should be appreciated that these embodiments of the present invention will work with many different types of insulating materials used for the insulating materials employed in the U-shaped cavity and within the safing slot as well as different types of the non-combustible material used for the 5-sided box pan as long as the material has effective high temperature insulating characteristics. Each curtain wall manufacturer/constructor has its own architectural design, which requires minor adjustments to the construction process. These include but are not limited to the water-tight gaskets, anchor bracket attachment method, and mullion/transom design.

The installed fireproof system achieved and an F-Rating of 120 min as well as a movement rating of class IV.

It has been shown that the installed fireproof system within an exterior dynamic curtain wall assembly of the present invention, maintains sealing of the sating slots surrounding the floor of each level in a building.

In particular, it has been demonstrated that the installed fireproof system within an exterior dynamic glass curtain wall assembly of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining sating insulation between the floors of a residential or commercial building and the exterior curtain wall responsive to various conditions including fire exposure is guaranteed.

Further, it has been shown, that the installed fireproof system within an exterior dynamic glass curtain wall assembly of the present invention meets the requirements of a full-scale ASTM E 2307 as well as full-scale ASTM E 1399 tested system for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

In particular, the tested system according to the present invention provides for the employment of reduced curtain wall insulation to only 6 inch height, resulting in up to 40% curtain wall material savings to the closest 10 inch spandrel system. Further, no top horizontal transom cover is needed for maximum vision glass/architectural exposure top of slab. Another great advantage of the installed fireproof system within an exterior dynamic curtain wall assembly of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

It has been shown that the process for installing the fireproof system makes it easier for the installers to build up the curtain wall on the jobsite.

The curtain wall design of the present invention clearly simplifies fire protection installation and can be used to add additional insulation for other mechanical purposes, such as for example STC, R-value, and the like.

Finally, it has been shown that the installed fireproof system within an exterior dynamic curtain wall assembly according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A fireproof system within a stick build exterior dynamic curtain wall façade, the fireproof system including at least a first L-shaped member, a second L-shaped member, and a thermally resistant material, wherein the fireproof system is assembled according to a process comprising:

assembling a framing structure by attaching one or more anchoring brackets to horizontal framing members and vertical framing members and to concrete and steel members of the façade to a building structure;

installing one or more appropriate water gasket seals to the framing members to seal the framing structure and building structure from water intrusion;

installing the first L-shaped member of a non-combustible material, having a first leg and a second leg perpendicular to each other, and the second L-shaped member of a non-combustible material, having a first leg and a second leg perpendicular to each other, such that the first leg of the first L-shaped member is fastened to an upper said horizontal framing member and an upper location of the vertical framing members and the first leg of the second L-shaped member is connected to the second leg of the first L-shaped member, thereby forming a substantially U-shaped cavity;

installing one or more supporting or attachment elements to fasten the substantially U-shaped cavity to an inner facing side of the vertical framing member, thereby forming a 5-sided box pan;

installing at least one additional element selected from the group consisting of gaskets, hardware, and components necessary to prepare the framing structure for glass installation;

completing the curtain wall façade by installing glass and one or more appropriate sealing layers to the façade;

installing the thermally resistant material into the substantially U-shaped cavity and a safing slot; and optionally, applying an outer fire retardant coating positioned across the thermally resistant material installed in the safing slot and adjacent portions of the vertical and horizontal framing members and a floor located thereadjacent.

2. The fireproof system according to claim 1, wherein the first L-shaped member and the second L-shaped member are comprised of a metal material.

3. The fireproof system according to claim 1, wherein the first L-shaped member and the second L-shaped member are comprised of an 18 gauge galvanized steel material.

4. The fireproof system according to claim 1, wherein the substantially U-shaped cavity is fastened by at least one element selected from the group consisting of a pin, an expansion anchor, a screw, a screw anchor, a bolt, and an adhesion anchor.

5. The fireproof system according to claim 1, wherein the supporting or attachment elements have a substantially L-shaped profile and are positioned so that a gap between the substantially U-shaped cavity and the vertical framing member is closed due to an architectural structure of the stick build exterior dynamic curtain wall façade.

6. The fireproof system according to claim 1, wherein the thermally resistant material is a thermally resistant flexible mineral wool material to facilitate placement thereof into the substantially U-shaped cavity.

7. The fireproof system according to claim 1, wherein the 5-sided box pan has a depth of about 3 inches and a height of about 6 inches.

8. The fireproof system according to claim 1, wherein a back of the substantially U-shaped cavity is positioned spatially disposed from the interior wall surface of the stick build exterior dynamic curtain wall façade.

9. The fireproof system according to claim 1, wherein the stick build exterior dynamic curtain wall façade comprises a vision glass and wherein the back of the substantially U-shaped cavity is positioned spatially disposed from the inner surface of the vision glass infill.

10. The fireproof system according to claim 1, wherein the outer fire retardant coating is applied, and wherein the outer fire retardant coating has a wet film thickness of about 2 mm to about 3.175 mm (⅛ inch).

11. The fireproof system according to claim 1, wherein the outer fire retardant coating is applied, and wherein the outer fire retardant coating is a water-based outer fire retardant coating or silicone-based outer fire retardant coating.

12. The fireproof system according to claim 1, wherein the outer fire retardant coating is applied, and wherein the outer fire retardant coating is in at least one form selected from the group consisting of an emulsion, a spray, a coating, a foam, a paint, and a mastic.

13. The fireproof system according to claim 1, wherein the fireproof system is an acoustic insulating and sealing system.

14. A stick build exterior dynamic curtain wall façade, comprising:

the fireproof system assembled according to claim 1, a vision glass infill, and one or more appropriate sealing layers.

15. A building construction, comprising:

a curtain wall construction defined by an interior wall surface including one or more framing members, and at least one floor spatially disposed from the interior wall surface of the curtain wall construction, thus defining a safing slot extending between the interior wall surface of the curtain wall construction and an outer edge of the at least one floor, wherein the curtain wall construction comprises the fireproof system assembled according to claim 1.

* * * * *